US008322066B2

(12) United States Patent
Westra

(10) Patent No.: US 8,322,066 B2
(45) Date of Patent: Dec. 4, 2012

(54) RAIL ATTACHMENT MECHANISM

(76) Inventor: Christopher Westra, Exeter, NH (US)

( * ) Notice: Subject to any disclaimer, the term of this patent is extended or adjusted under 35 U.S.C. 154(b) by 193 days.

(21) Appl. No.: 13/007,802

(22) Filed: Jan. 17, 2011

(65) Prior Publication Data

US 2012/0167436 A1 Jul. 5, 2012

Related U.S. Application Data

(60) Provisional application No. 61/295,920, filed on Jan. 18, 2010.

(51) Int. Cl.
*F41C 27/00* (2006.01)
*F41G 1/34* (2006.01)

(52) U.S. Cl. ..... 42/90; 42/146

(58) Field of Classification Search ..... 42/90, 114, 42/124, 127, 146
See application file for complete search history.

(56) References Cited

U.S. PATENT DOCUMENTS 5,155,915 A * 10/1992 Repa ..... 42/127
5,375,361 A * 12/1994 Rustick ..... 42/125
5,430,967 A * 7/1995 Woodman et al. ..... 42/114
5,787,630 A * 8/1998 Martel ..... 42/125
6,574,901 B1 * 6/2003 Solinsky et al. ..... 42/146
6,922,934 B1 * 8/2005 Huan ..... 42/127
6,931,778 B1 * 8/2005 Nelson et al. ..... 42/120
7,370,449 B1 * 5/2008 Beckmann ..... 42/90
7,735,255 B1 * 6/2010 Kincaid et al. ..... 42/146
2001/0022044 A1 * 9/2001 Spinner ..... 42/124
2002/0104249 A1 * 8/2002 Lin et al. ..... 42/114
2006/0117636 A1 * 6/2006 Newhall et al. ..... 42/124
2008/0092421 A1 * 4/2008 Beckmann ..... 42/90
2009/0038201 A1 * 2/2009 Cheng et al. ..... 42/127
2010/0229449 A1 * 9/2010 Matthews et al. ..... 42/90
2011/0067287 A1 * 3/2011 Collin et al. ..... 42/119
2011/0146128 A1 * 6/2011 Haering ..... 42/90
2011/0167703 A1 * 7/2011 Deros ..... 42/90
2011/0173866 A1 * 7/2011 Matthews et al. ..... 42/90

* cited by examiner

*Primary Examiner* — Bret Hayes

(57) ABSTRACT

An auxiliary device includes a housing and a rail mount coupled to the housing. The rail mount includes a first rigid member and a second rigid member extending substantially longitudinally along at least a portion of the housing, the first and second rigid members configured to engage a mounting rail defined on a frame portion of a weapon. The rail mount further includes a flex member having a first end coupled to the first rigid member and a second end coupled to a tightening member being movable between a first position and a second position, the flex member configured to provide a gripping force on the mounting rail of the weapon and couple the auxiliary device to the weapon. A shock absorbing member may be provided to prevent or reduce damage to an internal power supply upon discharge of the weapon.

18 Claims, 9 Drawing Sheets

RAIL ATTACHMENT MECHANISM

CROSS REFERENCE TO RELATED APPLICATIONS

The present application claims the benefit of U.S. Provisional Patent Application Ser. No. 61/295,920 filed Jan. 18, 2010 and entitled RAIL ATTACHMENT MECHANISM, which is fully incorporated herein by reference.

TECHNICAL FIELD

The present disclosure relates to mounting devices, and, more particularly, to a rail attachment mechanism for a firearm.

BACKGROUND

The need to effectively see a target and aim a weapon in the direction of the target is well-recognized. Auxiliary devices to facilitate illuminating a target or aiming a weapon are known. Examples of known auxiliary devices include scopes, visible and infrared illuminators, laser pointers, combined illuminator/laser pointer devices, night vision devices and infrared imagers. For convenience, these, and other, devices are generally referred to herein as auxiliary devices. Auxiliary devices are often mounted to weapons having rail mounting systems with a certain profile, for example a rail profile consistent with MIL-STD-1913 or a "Weaver" rail. It is desirable that the auxiliary device be quickly and easily securable to and removable from the rail. Although these rail profiles have tolerances, these tolerances can vary enough to cause auxiliary devices without the ability to accommodate different rail profiles and dimensions to either be too tight, thereby preventing a user from attaching the auxiliary device to the weapon, or too loose, thereby allowing the auxiliary device to rattle. An auxiliary device that is too loose may fall off during weapon fire or may fail to maintain bore sight after continued use.

In addition, users may encounter problems caused by the impact force to an auxiliary device mounted to a firearm when the firearm discharges. When a firearm discharges, recoil of the firearm is a common result. Recoil (often called kickback or simply kick) is generally understood to be the backward momentum of a firearm when it is discharged. Impact forces can cause damage to an auxiliary device mounted to the firearm. For example, the power supply (such as a battery) of an auxiliary device may be damaged due to the impact forces caused when the weapon is discharged. The batteries may sustain physical damage to the positive and/or negative terminals as a result of impact force against the interior of the housing in which they are enclosed. The physical damage may be in the form of deformed positive and/or negative terminals and/or shorts between the electrode in the battery and the positive and negative terminals resulting in a decrease or complete failure in power supply. This damage may further cause the batteries to rupture and leak caustic or corrosive material into the housing of the auxiliary device. These impact forces may also cause the batteries to shift at least partially out of alignment with contacts and result in a power failure.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

In general, a system consistent with the present disclosure may include an auxiliary device configured to be coupled to a weapon. The auxiliary device may include a housing and a rail mount coupled to the housing. The rail mount may include a first rigid member and a second rigid member extending along at least a portion of the housing, the first and second rigid members configured to engage a mounting rail defined on a frame portion of the weapon. The rail mount may further include a flex member having a first end coupled to the first rigid member and a second end coupled to a tightening member being movable between a first position and a second position, the flex member may be configured to provide a gripping force on the mounting rail of the weapon and couple the auxiliary device to the weapon. The auxiliary device may also include a shock absorbing member sized and shaped to retain an internal power supply within the auxiliary device. The shock absorbing member may be configured to resist and minimize effects of impact forces to the auxiliary device.

A system consistent with the present disclosure may provide a quick and easy method of securing and removing an auxiliary device to a weapon, and/or may prevent damage to auxiliary device and/or internal power supply from impact forces.

Figure 1:
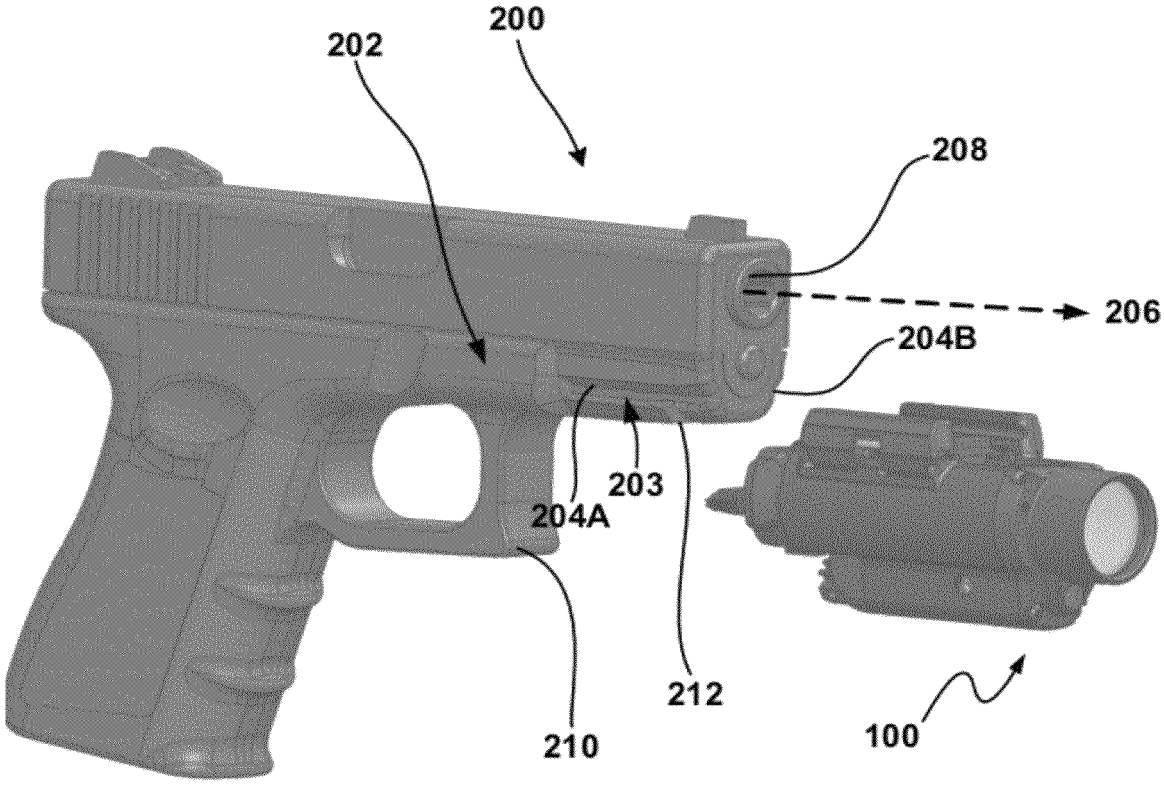
FIG. 1 is an isometric view of an auxiliary device consistent with a first embodiment of the present disclosure spaced from a handgun.

FIG. 1 is an isometric view of an auxiliary device 100 consistent with an embodiment of the present disclosure spaced from a firearm 200, shown as a handgun. According to one embodiment, firearm 200 includes a weapon frame 202 with a mounting rail 203 including grooves 204A and 204B located in and extending along at least a portion of the weapon frame 202 and generally parallel with an axis 206 of a barrel 208. In the illustrated embodiment, grooves 204A and 204B extend from about a trigger guard 210 to substantially the forward most end of frame 202 (an open rail). The weapon frame 202 may also include a slot (or other recess), for example, an elongate transverse slot 212, aligned substantially perpendicular to grooves 204A and 204B. The slot 212 may be located between the trigger guard 210 and the forward most portion of the frame 202. Although the firearm 200 is shown as a handgun, the auxiliary device 100 may be mounted to any weapon with a suitable mounting rail. It should be noted that in other embodiments, the auxiliary device 100 may be mounted to a weapon with a closed rail (rails that do not extend to the forward most end of the frame) without a transverse slot.

Figure 2:
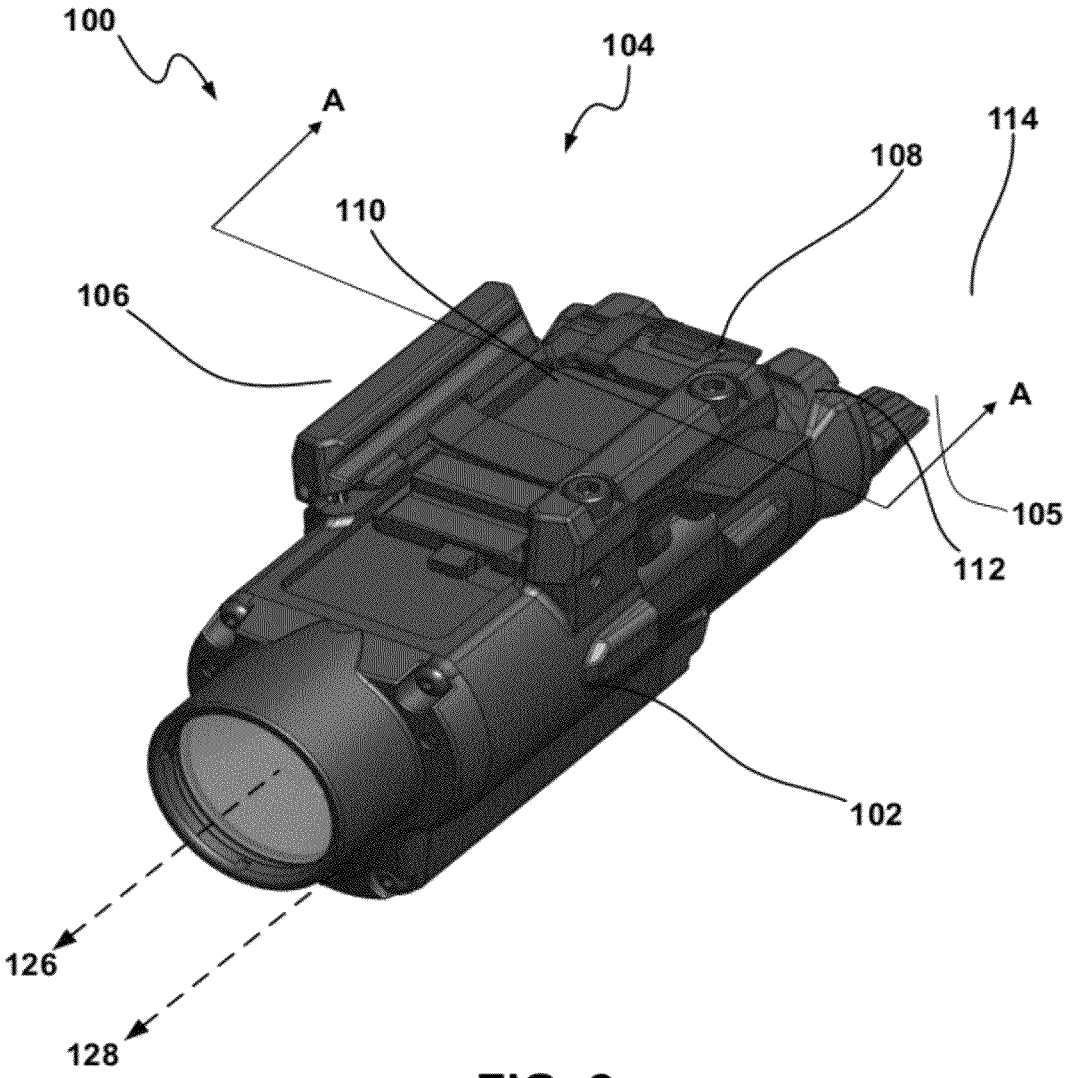
FIG. 2 is an isometric view of the auxiliary device of FIG. 1.

FIG. 2 is an isometric view of the auxiliary device 100 of FIG. 1. In the embodiments described herein, the auxiliary device 100 may be depicted and described as an illuminator that may be used to cast light upon a target area or a portion thereof. It is to be understood, however, that a system and method consistent with the present disclosure may be used in connection with a variety of auxiliary device configurations, and is not limited to illuminating auxiliary devices.

In the illustrated embodiment, the auxiliary device 100 includes a housing 102. The auxiliary device 100 may also include a first source of illumination 103A (shown in FIG. 3), for example an LED, incandescent or halogen bulb, or other light generating component for directing collimated or diverging light about an axis 126. The auxiliary device 100 may also include a second source of illumination 103B (shown in FIG. 3), for example a laser for directing collimated light (visible or infrared) or an LED, incandescent or halogen bulb, or other light generating component for directing collimated or diverging light about an axis 128. The axis 126 and axis 128 may be generally parallel with the axis 206 of the firearm 200.

In the illustrated embodiment, the auxiliary device 100 may also include a rail mount 104 including a first rigid member 106 and a second rigid member 108 extending longitudinally (e.g. in the direction of axis 126) along at least a portion of the housing 102. The second rigid member 108 may be transversely spaced (e.g. a direction generally perpendicular to the axis 126) from the first rigid member 106. The rail mount 104 may also include a flex member 110 having a first end 111A (shown in FIG. 4A) coupled to the first rigid member 106 and a second end 111B (shown in FIG. 4A) coupled to a tightening member 112 being movable between a first position and a second position. The auxiliary device 100 may further include on/off controls 114 for at least the first source of illumination 103A.

Figure 3:
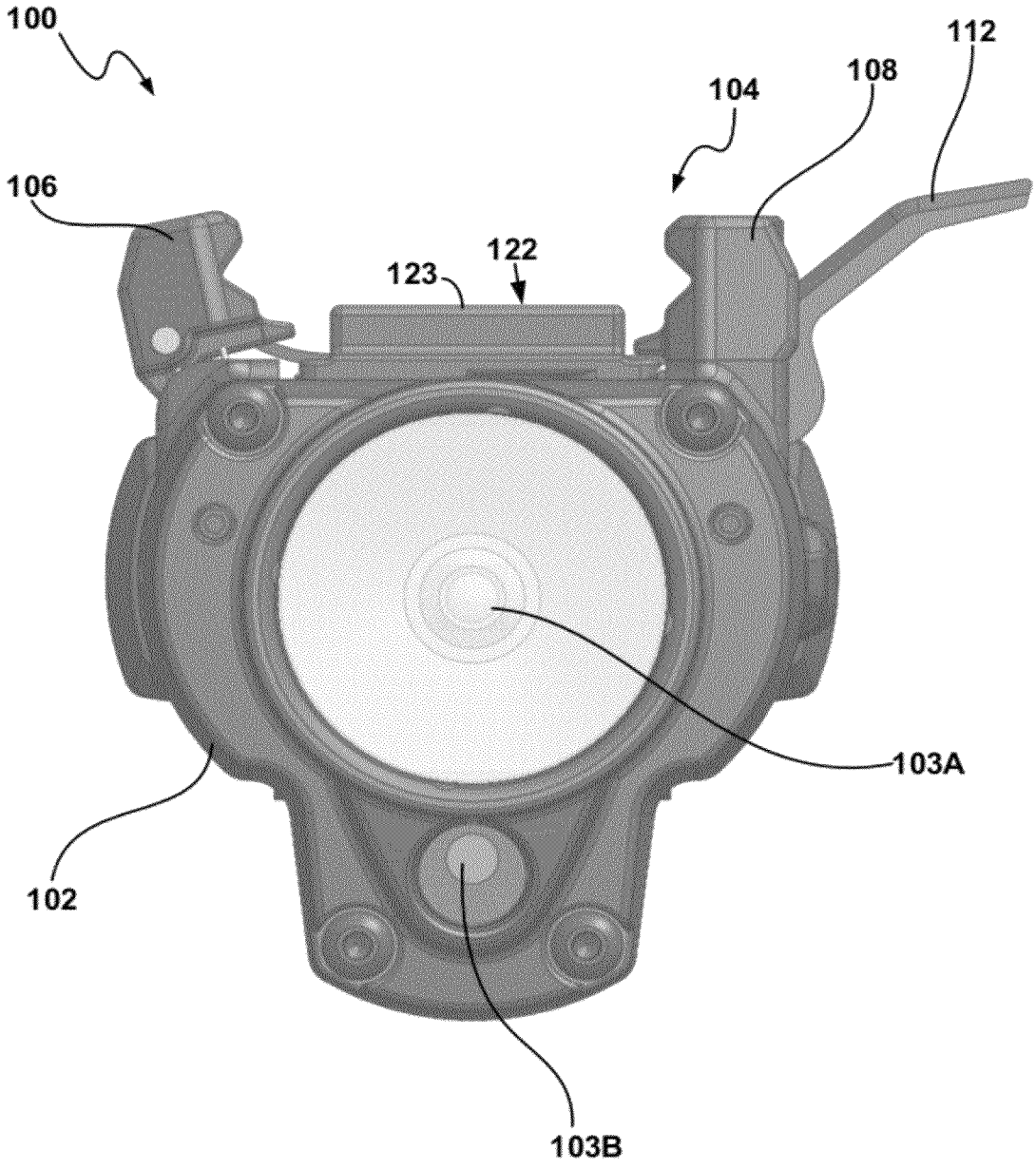
FIG. 3 is a front view of the auxiliary device of FIG. 1 with the mounting mechanism in a first position.

FIG. 3 is a front view of the auxiliary device 100 of FIG. 1 with the rail mount 104 in a first position. In the illustrated embodiment, the first and second rigid members 106, 108 may each include a longitudinal rail-engaging surface configured to matingly engage and couple to the mounting rail 203 of the firearm 200 allowing the auxiliary device 100 to be coupled and decoupled to the firearm 200. The rail-engaging surface may be contoured to correspond to the rails 203 and grooves 204A and 204B of the firearm 200.

The auxiliary device 100 may also include a stopper member 122 coupled to the housing 102 configured to prevent movement of the auxiliary device 100 relative to the firearm 200 in a direction substantially parallel to the axis 206. In one embodiment, a transverse protuberance 123 formed on the stopper member 122, for example a bar, upwardly extending pin(s), or other obstruction, may be sized and shaped to engage and cooperate with the transverse slot 212 on the firearm 200 when the rail mount 104 is placed on the mounting rail 203 and the grooves 204A and 204B are received between the first and second rigid members 106, 108 of the rail mount 104. The protuberance 123 may have a width (in the longitudinal direction) slightly smaller than the transverse slot 212 of the firearm 200. In one embodiment, the stopper member 122 may include a series of vertically standing ridges 134 (see FIG. 4A) sized and shaped to correspond to and cooperate with a series of vertically standing ridges 136 (see FIG. 4A) defined on a portion of the housing 102. The stopper member 122 may be positioned relative to the housing 102 to set the location of the stopper member 122 along the axis 126 and may be fixed in place with a fastener 138, for example a set screw inserted in aperture 140 defined on the housing 102.

Figure 4A:
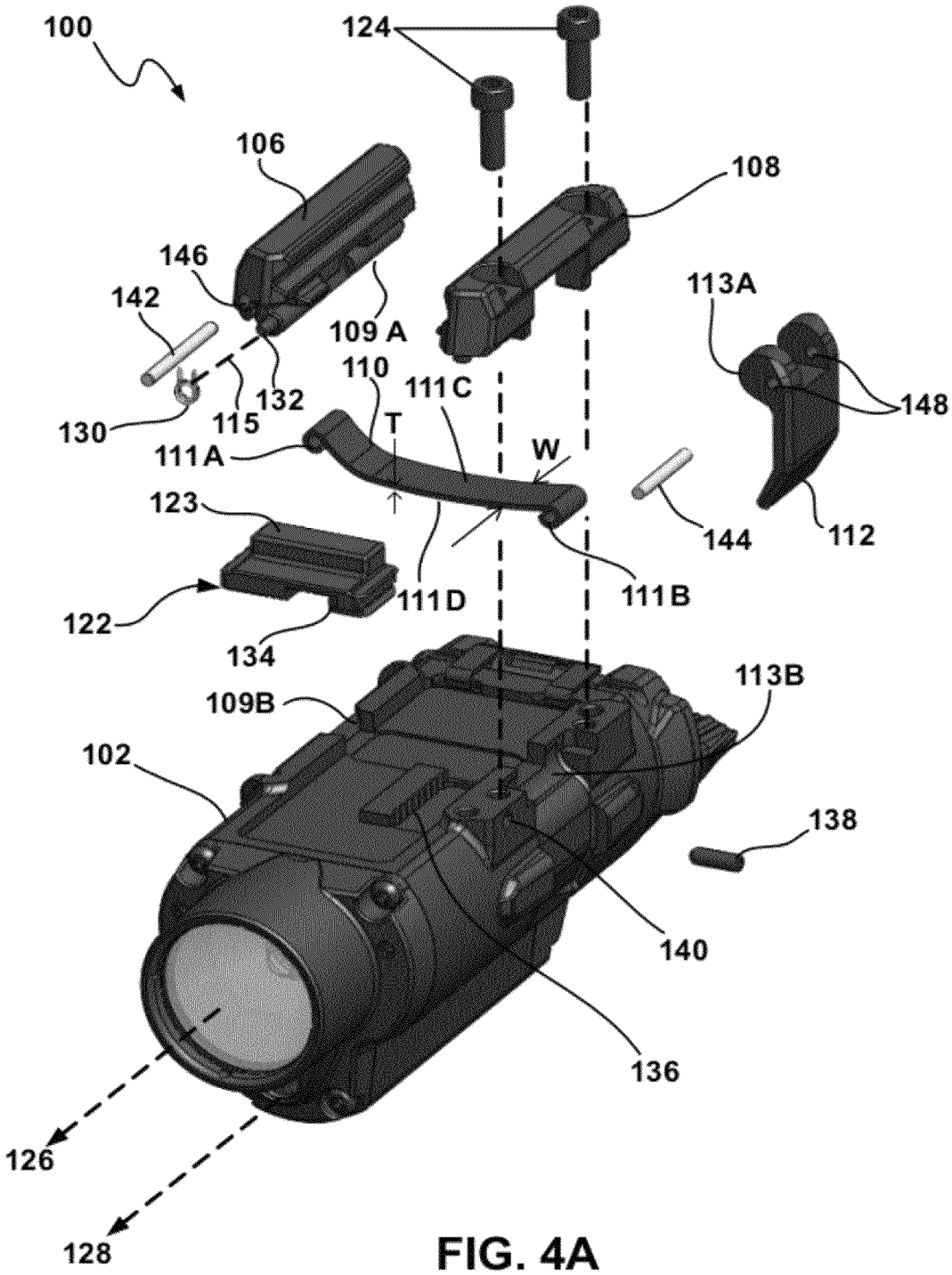
FIG. 4A is an exploded view of the auxiliary device of FIG. 1 with the mounting mechanism in a second position.
Figure 4B:
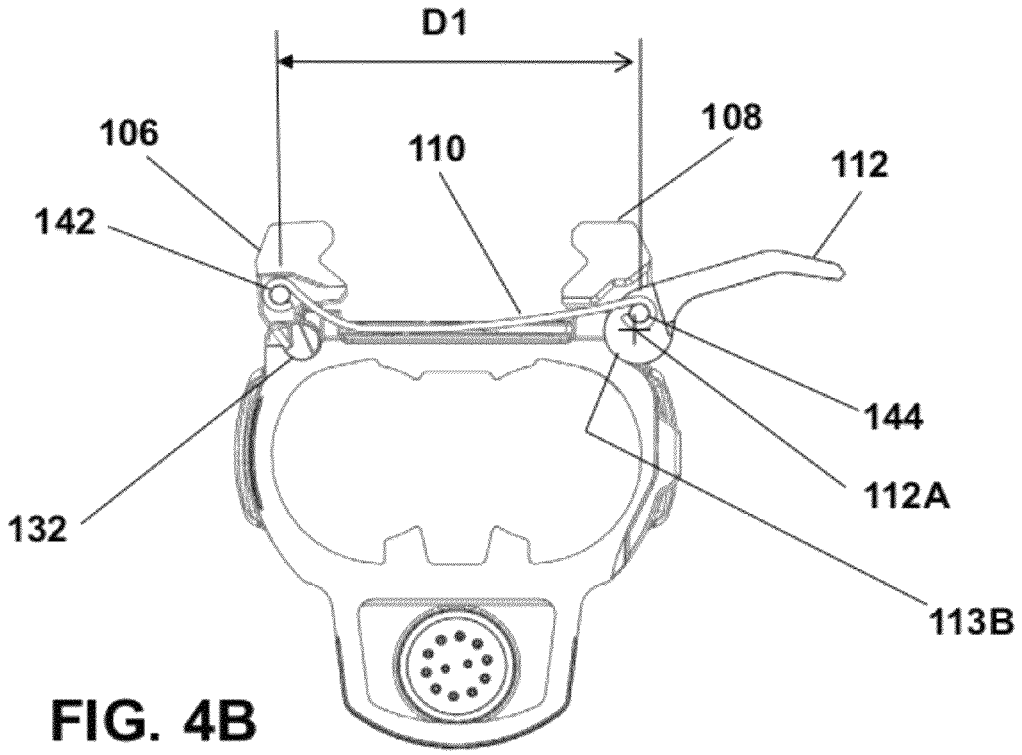
FIG. 4B is a section view of the auxiliary device of FIG. 1 taken through line AA in FIG. 2 with the mounting mechanism in the first position.
Figure 4C:
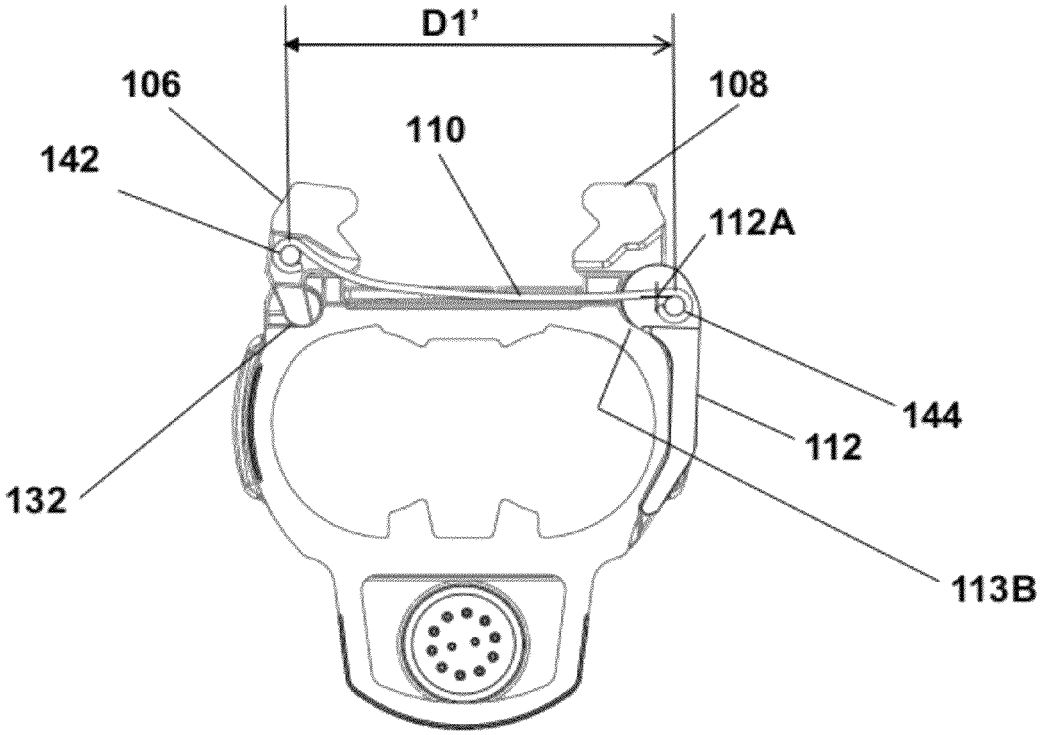
FIG. 4C is a section view of the auxiliary device of FIG. 1 taken through line AA in FIG. 2 with the mounting mechanism in the second position.
Figure 4D:
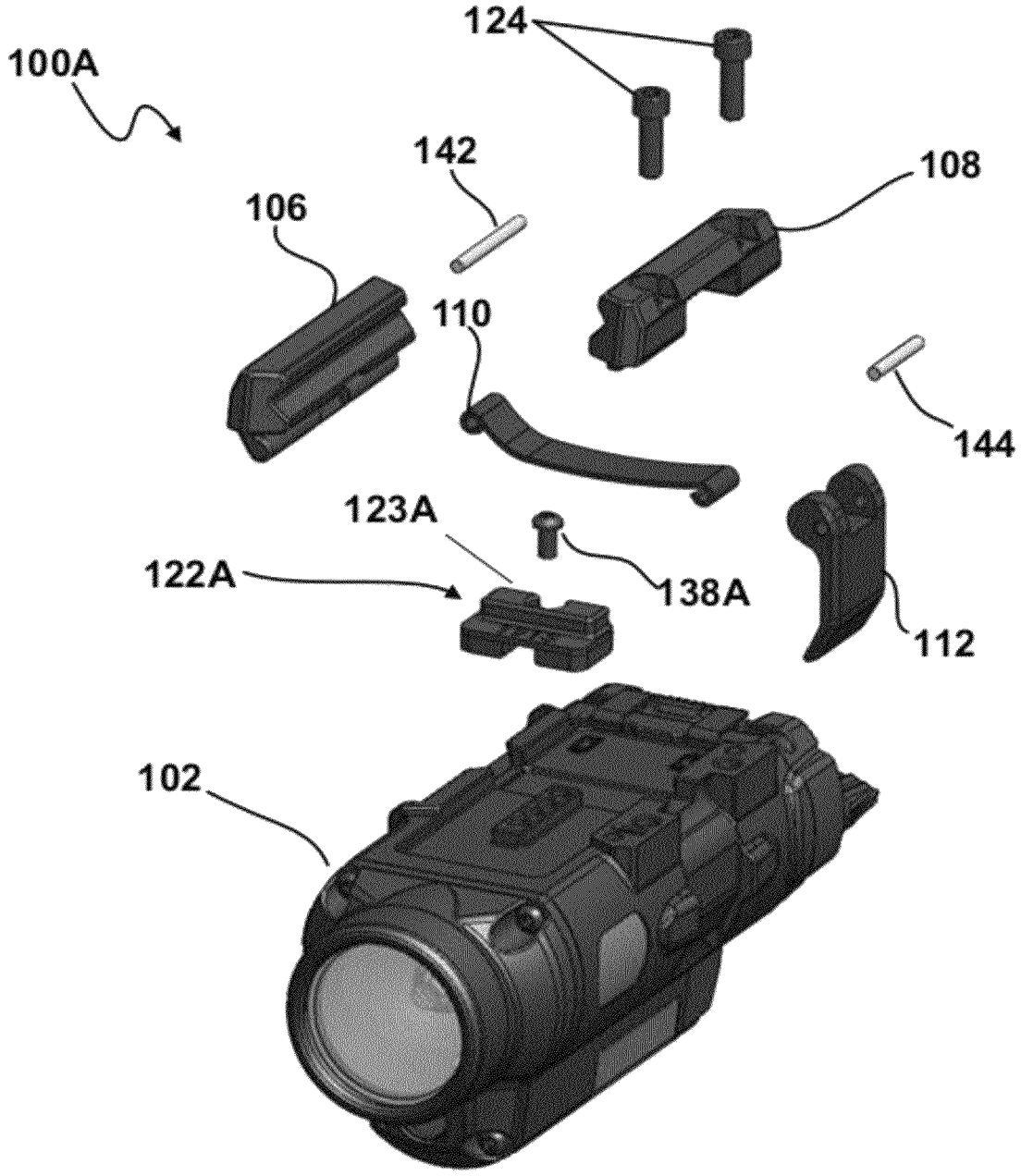
FIG. 4D is an exploded isometric view of an auxiliary device consistent with a second embodiment of the present disclosure.

In an embodiment illustrated in FIG. 4D, an auxiliary device 100A may include a stopper member 122A. The stopper member 122A may be positioned relative to the housing 102 to set the location of the stopper member 122A along the axis 126 and may be fixed in place with a fastener 138A. A transverse protuberance 123A formed on the stopper member 122A, for example a bar, upwardly extending pins, or other obstruction, may be sized and shaped to engage and cooperate with the transverse slot 212 on the firearm 200. In this embodiment, the auxiliary device 100A may have rigid members 106, 108, flex member 110, and tightening member 112 similar to those shown in FIG. 4A. Alternatively, a transverse protuberance may be integral to the housing 102.

As generally understood by one of ordinary skill in the art, the location of the transverse slot 212 on a firearm 200 relative to the front of the trigger guard 210 and the shape of the trigger guard 210 may not be standardized from one gun manufacturer to another. Allowing a user to set the position of the stopper member 122 along the axis 126 allows the user to set the distance of the rear surface of the auxiliary device 100, where the on/off controls 114 for the auxiliary device 100 may be located, from the trigger guard 210.

FIG. 4A is an exploded view of the auxiliary device 100 of FIG. 1 with the rail mount 104 in a second position; FIG. 4B is a section view of the auxiliary device 100 taken through line A-A in FIG. 2 with the mounting mechanism in the first position; and FIG. 4C is a section view of the auxiliary device 100 taken through line A-A in FIG. 2 with the mounting mechanism in a second position. In the illustrated embodiment, the first and second rigid members 106, 108 may be detachably coupled to the housing 102. In one embodiment, the second rigid member 108 may be coupled to the housing 102 with one or more fasteners, for example screws 124, or an adhesive. Alternatively, the second rigid member 108 may be an integral part of the housing 102, i.e. not removable. The first rigid member 106 may be rotatable or translatable relative to the housing 102 to vary the transverse distance between at least a portion of the first rigid member 106 and the second rigid member 108 to allow the mounting rail 203 of the frame 202 of the firearm 200 to be inserted and secured therebetween. For example, in the illustrated embodiment, the first member rigid member 106 may rotate about an axis 115 and the second rigid member 108 may be fixed to the housing 102. When the tightening member 112 is in the first position (shown in FIG. 4B), the first rigid member 106 may generally rotate about axis 115, however, when the tightening member 112 is in the second position (shown in FIG. 4C), at least a portion of the first rigid member 106 may be pulled closer to the second rigid member 108 by the flex member 110 to squeeze the rail 203 to couple the auxiliary device 100 to the frame 202.

A bottom surface 109A of the first rigid member 106 may be contoured such that the bottom surface 109A and a receiving portion 109B of the housing 102 may be complementary, for example convex and concave, respectively, to allow the first rigid member 106 to rotate about the axis 115. Alternatively, the housing 102 may have a feature(s) to allow the first rigid member 106 to translate generally perpendicular to the axis 126. A spring 130, for example a torsion spring, may be used to bias the first rigid member 106 either towards or away from the second rigid member 108 and may be held in place on a protrusion 132.

Flex member 110, for example a section of spring steel or a high-strength elastic material, may be coupled at the first end 111A to at least a portion of the first rigid member 106, for example with a pin 142 and coupled at the second end 111B to the tightening member 112, for example with a pin 144. The flex member 110 may also include a top surface 111C and a bottom surface 111D. The flex member 110 may be flexible and have a thickness T that is substantially less than its width W measured parallel to the axis 126, within a range of two to twenty times less than the width W. For example, in one embodiment, the width W of the flex member 110 may be at least two times greater than the thickness T of the flex member 110. In another embodiment, the width W of the flex member 110 may be at least five times greater than the thickness T of the flex member 110. In another embodiment, the width W of the flex member 110 may be at least twenty times greater than the thickness T of the flex member 110.

When the auxiliary device 100 is mounted to the firearm 200, the flex member 110 may be positioned between the frame 202 and a top surface of the housing 102. In a relaxed state (when the tightening member 112 is in the first position, see FIG. 4B), the distance between the center of a loop or other grasping feature at the first end 111A of the flex member 110 and the center of a loop or other grasping feature at the second end 111B may be a first distance D1 and in a tensioned state (when the tightening member 112 is in the second position, see FIG. 4C), the distance between the center of the loop or other grasping feature at the first end 111A of the flex member 110 and the center of the loop or other grasping feature at the second end 111B may be a greater distance D1'.

Although the flex member 110 may look like a leaf spring in the relaxed state, it may operate like a tension spring. Those skilled in the art will recognize that the flex member 110 may include a variety of different shapes in the relaxed and tensioned states.

The pin 142 may be sized and shaped to fit in an aperture 146 defined in the first rigid member 106 and pin 144 may be sized and shaped to fit in openings 148 defined in the tightening member 112. The tightening member 112 may define a cammed surface 113A sized and shaped to correspond to and cooperate with a receiving surface 113B defined on the housing 102. The tightening member 112 may rotate about an axis 112A that is spaced from the axis of the pin 144. The location of the axis 112A relative to the pin 144 may cooperate to form an over-center mechanism to resist movement of the tightening member 112 from the second position to the first position.

The tightening member 112 is configured to be movable between the first position (shown in FIGS. 3 and 4B) and the second position (shown in FIGS. 4A and 4C). When the tightening member 112 is in the first position shown in FIG. 3, a user may insert the frame 202 of the firearm 200 between the first and second rigid members 106, 108 and then align the stopper member 122 with the transverse slot 212 on the firearm 200. When the tightening member 112 is in the first position, the first rigid member 106 may be moveable and/or rotatable about axis 115, while the second rigid member 108 may remain fixed relative to the housing 102. The user may then rotate the tightening member 112 downward to the second position thereby causing the flex member 110 to exert a pulling force on the first rigid member 106 in a direction toward the second rigid member 108, causing the first rigid member 106 to move and/or rotate about axis 115. In turn, the first rigid member 106 may continue to move and/or rotate about axis 115 until the first and second rigid members 106, 108 securely grip the frame 202. Thus, when the tightening member 112 is in the first position, at least a portion of the fixed second rigid member 108 may be mateably engaged with at least a portion of the frame 202 of the firearm 200 while the first rigid member 106 is moveable, allowing the auxiliary device 100 to be removed from the firearm 200. However, when the tightening member 112 is in the second position, as shown in FIGS. 4A and 4C, the first rigid member 106 may be pulled in a direction towards the second rigid member 108 and the frame 202, wherein the first rigid member 106 may be mateably engaged with a portion of the frame 202, thereby causing the auxiliary device 100 to be securely coupled to the firearm 200. Movement of the tightening member 112 from the first position to the second position may cause the flex member to distort as it attempts to pull the first rigid member 106 towards the second rigid member 108, thereby squeezing the rail 203 therebetween.

Electrically conductive spring contacts have been used in electronic devices to electrically connect to the positive and negative terminals of a battery. The spring contacts have been used to compensate for the battery length not being consistent and to ensure a good contact is made with the battery. When an auxiliary device is mounted on a weapon the shock developed when the weapon is fired may be transferred to the auxiliary device and in turn to any internal components and an associated power supply, for example the battery. These spring contacts may allow the battery to move back and forth along the axis of the barrel of the weapon and the shock may break electrical connections between the electrode in the battery and the positive and negative terminals, typically located at opposing ends of the battery. When the weapon is an automatic pistol, shock caused by the slide moving forward may have to be accommodated, in addition to the shock caused by recoil of the weapon.

Figure 5:
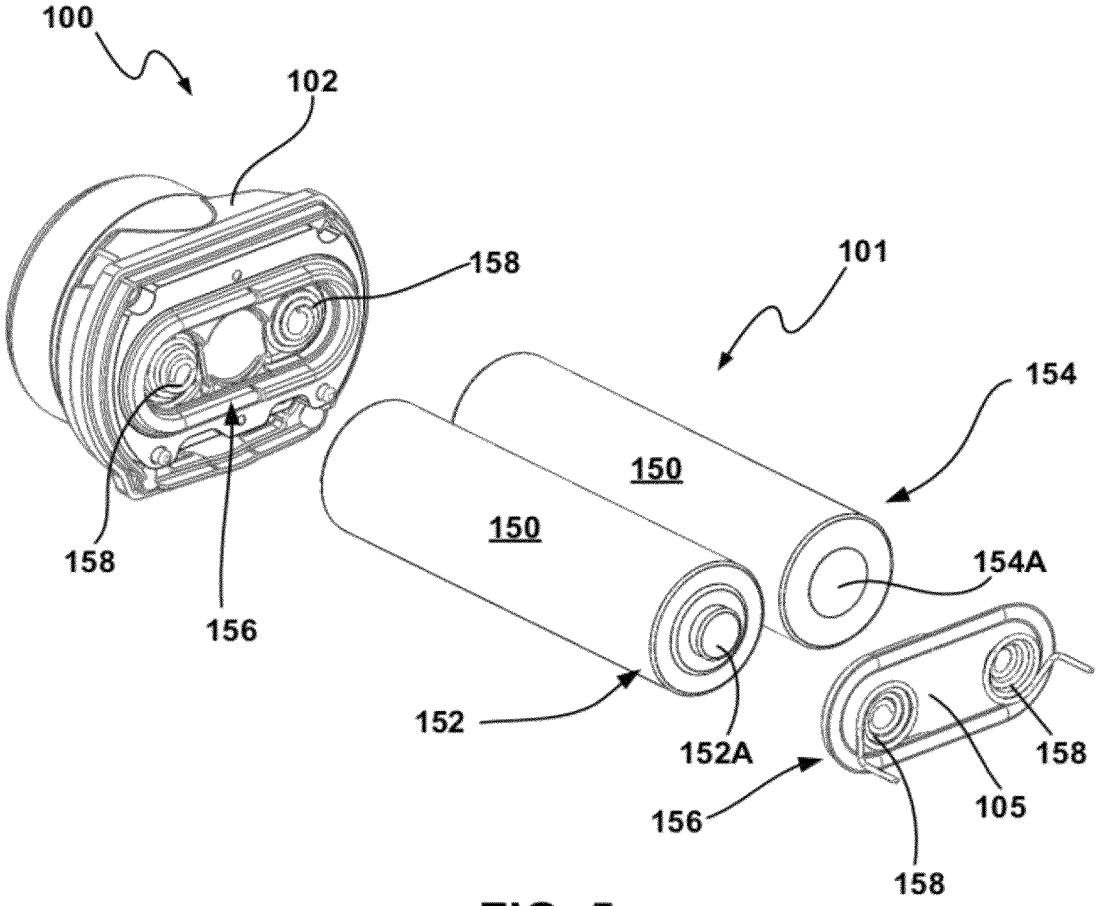
FIG. 5 is an isometric view showing a power supply portion of the auxiliary device of FIG. 1.

FIG. 5 is an isometric view showing a power supply portion 101 the auxiliary device 100 of FIG. 1. As shown, the power supply portion 101 may include two AA-type battery 150 enclosed in the housing 102. Although the batteries 150 may be described as AA-type batteries, it is to be understood that a system and method consistent with the present disclosure may be used in connection with a variety of types/sizes and quantity of batteries. Also, an auxiliary device 100 consistent with the present disclosure may include any number of batteries 150 connected in series or parallel as a source of electrical energy, or may include only a single battery 150.

In the illustrated embodiment, each battery 150 may be cylindrically shaped with a positive end 152 having a positive terminal 152A for making an electrical connection and a negative end 154 having a negative terminal 154A for making an electrical connection. The positive terminal 152A may extend past the generally cylindrical shape of the battery like a nipple. The association of the positive terminal of the battery with the end of the battery having the nipple may be switched without departing from this disclosure. The auxiliary device 100 may further include a cover 105 (see FIG. 7) detachably coupled to the housing 102. The cover 105 may be configured to retain each battery 150 in place and in electrical contact with an associated electrically conductive spring contact 158.

In the illustrated embodiment, the housing 102 and/or cover 105 may include a shock absorbing member 156. The shock absorbing member 156 may be coupled to at least the cover 105 and/or the housing 102 via an adhesive. However, as generally understood by one skilled in the art, the shock absorbing member may be coupled to the cover 105 and/or housing 102 via any appropriate coupling means. The shock absorbing member 156 may be sized and shaped to retain the at least one battery 150 in alignment with the contact 158 of the cover 105 and/or the housing 102. The shock absorbing member 156 may also be configured to resist and minimize effects of impact forces to the at least one battery 150 and/or housing 102.

Figure 6:
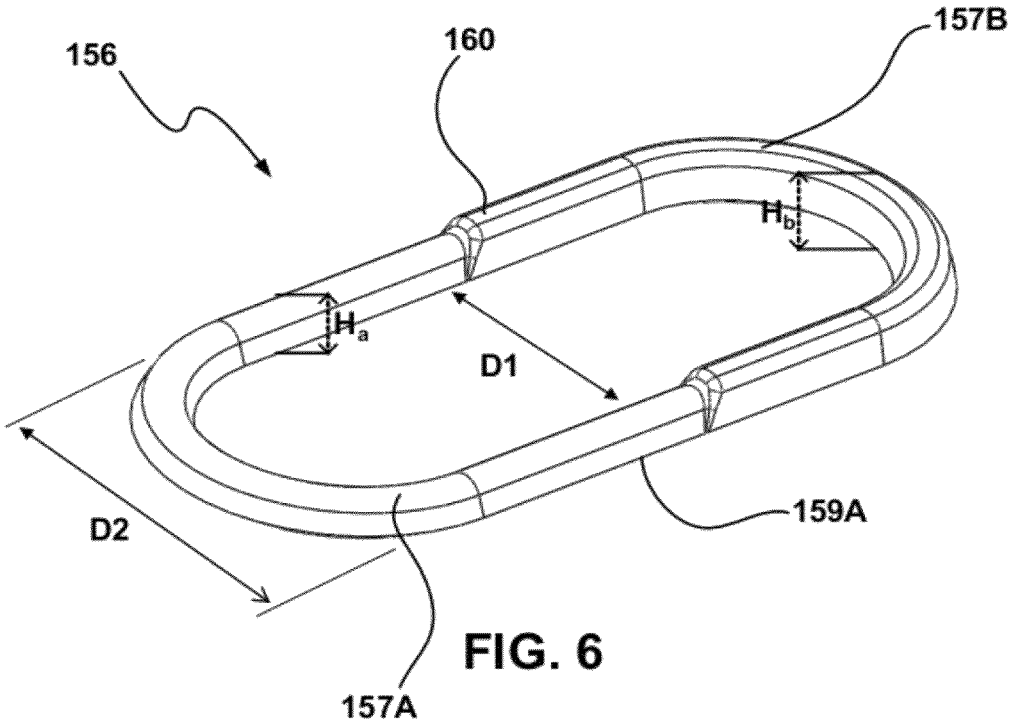
FIG. 6 is an isometric view of a shock absorbing member of the auxiliary device of FIG. 5.

FIG. 6 is an isometric view of the shock absorbing member 156 of the auxiliary device 100 of FIG. 5. In the illustrated embodiment, the shock absorbing member 156 may define a generally oval structure extending along a periphery of the cover 105. The shock absorbing member 156 may also define a bottom surface 159A. The bottom surface 159A may be substantially flat. In other embodiments, the bottom surface 159A may be contoured such that the bottom surface 159A and a receiving portion 159B (shown in FIG. 8) of the housing 102 and/or cover 105 may be complementary, for example convex and concave, respectively, to allow the shock absorbing member 156 to matingly engage with and couple to the housing 102 and/or cover 105.

The shock absorbing member 156 may extend along the entire periphery of the cover 105. In other embodiments, however, the shock absorbing member may extend at least along a portion of the periphery of the battery 150. The shock absorbing member 156 may include a flexible, resilient, deformable, and/or electrically non-conductive material configured to resist and/or minimize impact forces against the auxiliary device 100, housing 102, and/or batteries 150. Examples of materials include, but are not limited to, elastomers, polyurethane, nylon (polyamides), polyester, polyethylene, polypropylene, PVC, fluoroplastics, block copolymers, polyethers and composites thereof. In the illustrated embodiment, the shock absorbing member 156 defines a single and continuous structure.

In other embodiments, the shock absorbing member 156 may define a plurality of structures formed on and arranged along at least a portion of the periphery of the battery 150, the cover 105, and/or the housing 102. The shock absorbing member 156 may be used in combination with any type of auxiliary device when shock absorption and protection from impact forces is desirable. In the embodiment shown, the shock absorbing member 156 is sized such that an outside dimension D2 is less than the dimension of the outside diameter of the battery 150 and an inside dimension D1 is slightly greater than the outside diameter of the nipple on the end of the battery.

Those skilled in the art will recognize that the shape of the shock absorbing member 156 may vary greatly to accommodate desired function. It is to be understood that the relative thickness, width, and/or circumference of the shock absorbing member 156 may vary depending on the type of internal power supply required, e.g., type-D batteries instead of type-AA batteries, as well as the amount of internal power supply required, e.g., four batteries instead of two batteries.

In the illustrated embodiment, the shock absorbing member 156 may define a first portion 157A having a height $H_a$ and a second portion 157B having a height $H_b$, wherein height $H_a$ is less than height $H_b$. For example, in one embodiment, the height $H_a$ of the first portion 157A may be at least two times less than the height $H_b$ of the second portion 157B.

Figure 7:
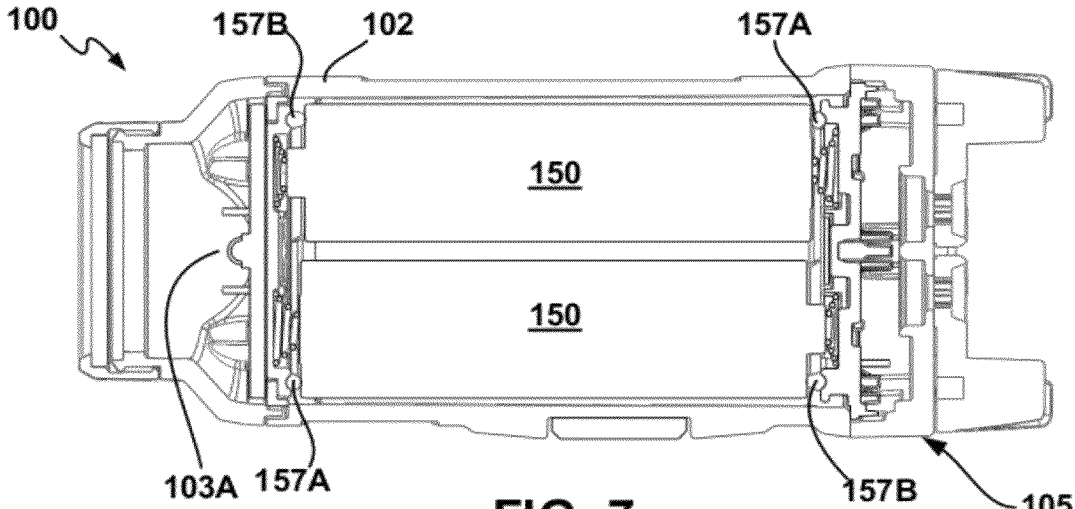
FIG. 7 is a cross-sectional view of a portion of the auxiliary device of FIG. 1.
Figure 8:
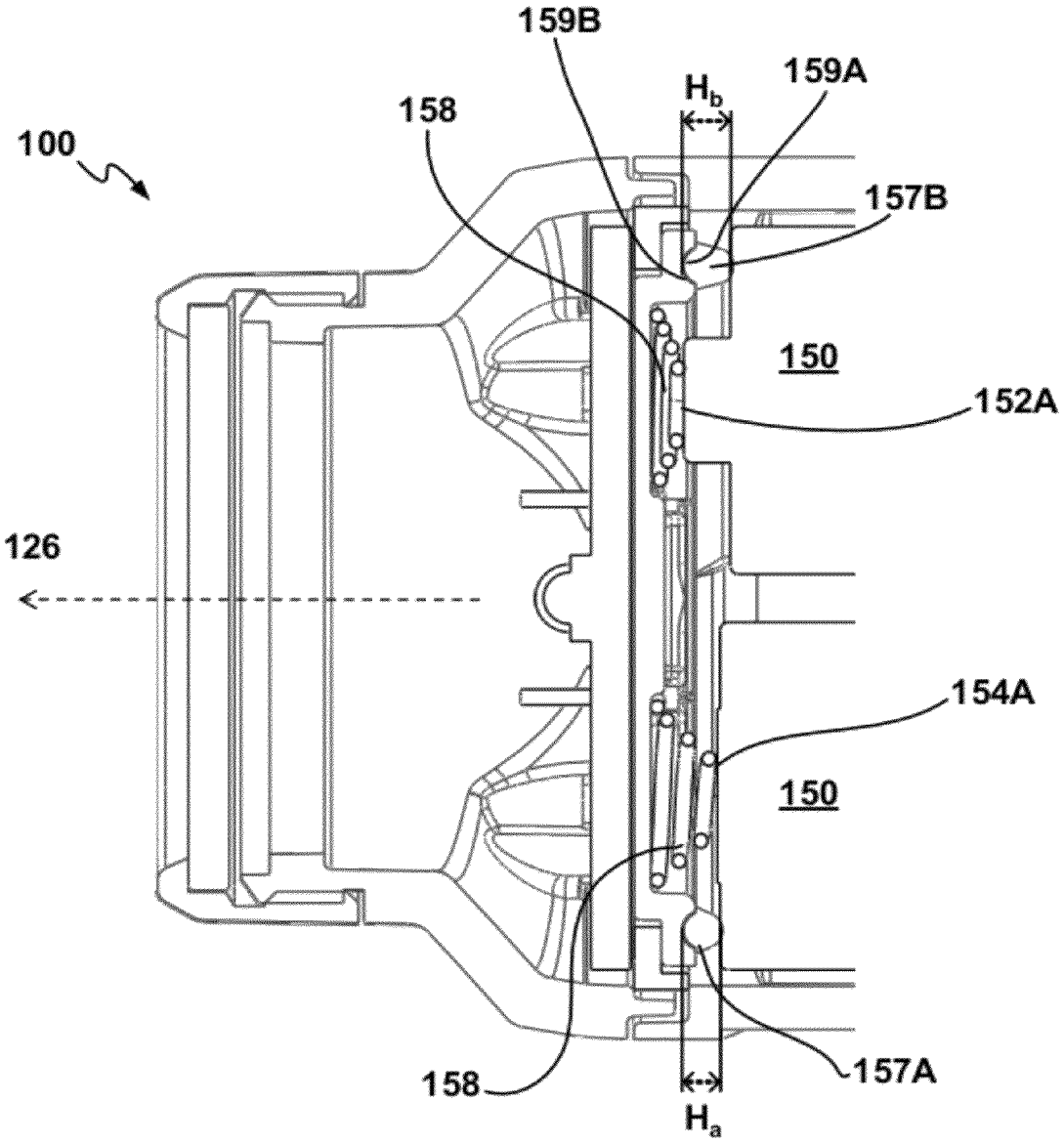
FIG. 8 is an enlarged cross-sectional view of a portion of the auxiliary device of FIG. 1.

FIG. 7 is a cross-sectional view and FIG. 8 is an enlarged cross-sectional view of a portion of the auxiliary device 100 of FIG. 1. With reference also to FIG. 5, in the illustrated embodiment, the first portion 157A may be sized and shaped to engage at least a portion of the negative terminal 154A. The second portion 157B is sized and shaped to fit around at least a portion of the positive terminal 152 of the other battery 150. In particular, the second portion 157B may engage at least a portion of area surrounding the positive terminal 152A.

The second portion 157B of the shock absorbing member 156 may have the height $H_b$ greater than the height $H_a$ of the first portion 157A in order to compensate for the difference in distance from the cover 105 to the negative end of the battery compared to the positive end of the battery. The shock absorbing member 156 may have a generally tapered cross-section, wherein the bottom surface 159A may gradually taper in width in a direction towards a top surface 160. The bottom surface 159A may have a width greater than a width of the top surface 160. In other embodiments, the width of the bottom and top surfaces 159A, 160 may not vary. Alternatively, one battery may be shifted longitudinally relative to the other battery and the shock absorbing member 156 may have a generally uniform thickness.

Impact forces caused by the discharge of the firearm 200 may be translated from the firearm to at least the auxiliary device 100, and, more particularly, to the housing 102. In turn, the batteries 150 may be forced against at least a portion of the shock absorbing member 156 positioned on the housing 102 and/or the cover 105. The force of the batteries 150 pressing against the shock absorbing member 156 may cause the shock absorbing member 156 to compress and deform, thereby absorbing the impact force. As a result, the effect of the impact force against the batteries 150 may be minimized.

In other embodiments, however, the shock absorbing member 156 may define a plurality of portions sized and shaped to retain a plurality of batteries varying in size and/or terminal orientation. For example, in one embodiment the shock absorbing member 156 may define at least three portions (not shown) sized and shaped to retain at least three batteries (not shown) in alignment with contacts of the cover 105 and the housing 102.

In one aspect, therefore, the present disclosure may feature an auxiliary device. The auxiliary device may include a housing and a rail mount coupled to the housing. The rail mount may include a first rigid member and a second rigid member extending substantially longitudinally along at least a portion of the housing. The first and second rigid members may be configured to engage a mounting rail defined on a frame portion of a weapon and at least couple the auxiliary device to the weapon, wherein the first and second rigid members are aligned substantially parallel with a barrel of the weapon. The rail mount may also include a flex member having a first end coupled to the first rigid member and a second end coupled to a tightening member being movable between a first position and a second position. The flex member may be configured to provide a gripping force on the rail of the weapon when the tightening member is in the second position.

In another aspect, the present disclosure may feature a system. The system may include a weapon and an auxiliary device coupled to the weapon. The auxiliary device may include a housing and a rail mount coupled to the housing. The rail mount may include a first rigid member and a second rigid member extending substantially longitudinally along at least a portion of the housing. The first and second rigid members may be configured to engage a mounting rail defined on a frame portion of the weapon and at least couple the auxiliary device to the weapon, wherein the first and second rigid members are aligned substantially parallel with a barrel of the weapon. The rail mount may further include a flex member having a first end coupled to the first rigid member and a second end coupled to a tightening member being movable between a first position and a second position. The flex member may be configured to provide a gripping force on the rail of the weapon when the tightening member is in the second position.

In yet another aspect, the present disclosure may feature a method including providing a weapon having a frame portion defining a mounting rail and providing an auxiliary device including a housing and a rail mount coupled to the housing, the rail mount having a first rigid member and a second rigid member extending substantially longitudinally along at least a portion of the housing. The first and second rigid members may be configured to engage the mounting rail of the weapon. The rail mount may further include a flex member having a first end coupled to the first rigid member and a second end coupled to a tightening member being movable between a first position and a second position, the flex member being configured to provide a gripping force on the mounting rail of said weapon when the tightening member is in the second position. The method may further include positioning the mounting rail of the weapon within the first and second rigid members of the rail mount and moving the tightening member from the first position to the second position to couple the first and second rigid members to the mounting rail of the weapon.

In yet another aspect, the present disclosure may feature a weapon-mountable auxiliary device may have shock absorbing members on opposing ends of a battery inserted therein to dampen shock caused by the weapon being fired.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. An auxiliary device comprising:

a housing; and a rail mount coupled to the housing, the rail mount comprising:

a first rigid member and a second rigid member extending substantially longitudinally along at least a portion of the housing, the first and second rigid members configured to engage a mounting rail defined on a frame portion of a weapon for coupling the auxiliary device to the weapon, wherein the first and second rigid members are aligned substantially parallel to each other;

a tightening member;

a flex member having a first end coupled to the first rigid member and a second end coupled to the tightening member, the tightening member being movable between a first position and a second position, the flex member having a thickness that is substantially less than its width.

2. The auxiliary device of claim 1, wherein the width is greater than 2 times greater than the thickness.

3. The auxiliary device of claim 1, wherein the width is greater than 5 times greater than the thickness.

4. The auxiliary device of claim 1, wherein the width is greater than 10 times greater than the thickness.

5. The auxiliary device of claim 1, wherein the tightening member is in contact with the housing and rotation of the tightening member causes at least a portion of the first rigid member to move closer to the second rigid member.

6. The auxiliary device of claim 5, wherein the flex member is coupled to the tightening member with a first longitudinally extending pin.

7. The auxiliary device of claim 6, wherein when the tightening member is in the second position, the first and second rigid members are configured to provide a compressive force to a rail of a weapon disposed between the rigid members.

8. The auxiliary device of claim 7, wherein an axis of the pin is spaced from an axis of rotation of the tightening member so as to prevent rotation of the tightening member from the second position to the first position where the first and second rigid members are spaced sufficiently to allow the rail of the weapon to be inserted therebetween.

9. The auxiliary device of claim 1, further comprising a stopper member coupled to the housing and configured to prevent movement of the auxiliary device relative to a weapon substantially parallel to a barrel when the auxiliary device is coupled to a weapon.

10. The auxiliary device of claim 1, wherein the first rigid member is moveable relative to the housing and the second rigid member is fixed relative to the housing when the tightening member is in the first position.

11. The auxiliary device of claim 1, wherein the first and second rigid members comprise a longitudinal surface configured to matingly engage a mounting rail of a weapon.

12. The auxiliary device of claim 1, wherein the flex member flexes when the tightening member is rotated from the first position to the second position, the flex member being configured to exert a pulling force on the first rigid member in a direction towards the second rigid member.

13. The auxiliary device of claim 1, further comprising:

a cover detachably coupled to the housing, the cover being configured to retain a battery having a positive end disposed on a first end of the battery and a negative end disposed on a second and opposing end of the battery, a first non-conductive shock absorbing member disposed between the first end of the battery and a portion of the housing; and a second non-conductive shock absorbing member disposed between the second end of the battery and the cover.

14. The auxiliary device of claim 13, wherein the auxiliary device and cover are configured to retain a second battery in a opposite orientation, wherein the first shock absorbing member defines a first portion in physical contact with the positive end of the first battery, the first portion having a first height, and a second portion in physical contact with the negative end of the second battery, the second portion having a second height, the first height being less than the second height.

15. The auxiliary device of claim 6, wherein the flex member is couple to the first rigid member with a second longitudinally extending pin auxiliary, the distance between the center lines of the first pin and the second pin increasing as the tightening member is moved from the first position to the second position.

16. An auxiliary device comprising:

a housing;

a first source of illumination;

a first rigid member coupled to the housing and extending substantially longitudinally;

a second rigid member generally parallel with the first rigid member, the first and second rigid members configured to engage a mounting rail on a weapon and couple the auxiliary device to the weapon;

a tightening member; and a flex member having a first end coupled to the first rigid member and a second end coupled to the tightening member, the tightening member being movable between a first position and a second position, the shape of the flex member configured to change as the tightening member is moved from the first position to the second position.

17. The auxiliary device of claim 16, wherein the width of the flex member is greater than 2 times greater than its thickness.

18. The auxiliary device of claim 16, wherein the width of the flex member is greater than 5 times greater than its thickness.

* * * * *